United States Patent [19]

Sugahara

[11] Patent Number: 4,907,495

[45] Date of Patent: Mar. 13, 1990

[54] PNEUMATIC CYLINDER WITH INTEGRAL CONCENTRIC HYDRAULIC CYLINDER-TYPE AXIALLY COMPACT BRAKE

[76] Inventor: Sumio Sugahara, 1781-3, Furuichiba, Saiwai-ku, Kawasaki-shi, Japan

[21] Appl. No.: 298,296

[22] Filed: Jan. 17, 1989

Related U.S. Application Data

[63] Continuation of Ser. No. 41,971, Apr. 24, 1987, abandoned.

[30] Foreign Application Priority Data

Apr. 30, 1986 [JP] Japan ..... 61-100600

[51] Int. Cl.[4] ..... F15B 15/22; F15B 15/26

[52] U.S. Cl. ..... 92/9; 92/10; 92/11; 92/108; 92/113; 188/300; 188/313; 267/64.26

[58] Field of Search ..... 92/9–12, 92/108–109, 113–114; 188/300, 313; 267/64.26

[56] References Cited

U.S. PATENT DOCUMENTS

| | | | |
|---|---|---|---|
| 3,176,801 | 4/1965 | Huff | 92/9 X |
| 3,830,139 | 8/1974 | Wachsman | 92/12 |
| 3,905,425 | 9/1975 | Jackson | 188/300 X |
| 3,929,057 | 12/1975 | Kondo | 92/12 |
| 4,445,671 | 5/1984 | Reuschenbach et al. | 188/300 X |
| 4,526,088 | 7/1985 | Reuschenbach | 92/12 |
| 4,528,894 | 7/1985 | Crosby | 92/12 |
| 4,765,225 | 8/1988 | Birchard | 92/9 X |

FOREIGN PATENT DOCUMENTS

| | | | |
|---|---|---|---|
| 2053819 | 7/1971 | Fed. Rep. of Germany | 92/12 |
| 2607157 | 8/1977 | Fed. Rep. of Germany | 92/12 |
| 3017403 | 11/1981 | Fed. Rep. of Germany | 92/12 |
| 1646 | 3/1966 | Japan | 92/12 |

*Primary Examiner*—Robert E. Garrett
*Assistant Examiner*—George Kapsalas
*Attorney, Agent, or Firm*—Foley & Lardner, Schwartz, Jeffery, Schwaab, Mack, Blumenthal & Evans

[57] ABSTRACT

A composite hydraulic cylinder apparatus which has a pneumatic cylinder mechanism, a braking oil hydraulic cylinder mechanism associated concentrically with the pneumatic cylinder mechanism, an oil passage for communicating between the front chamber and the rear chamber of the oil hydraulic cylinder mechanism, and a control valve provided in the oil passage for controlling the flow of the oil. Thus, the apparatus provides high positioning accuracy, a large holding force, economy and small size as a movable element control system, and can be applied as a buffer for the movable element.

8 Claims, 3 Drawing Sheets

PNEUMATIC CYLINDER WITH INTEGRAL CONCENTRIC HYDRAULIC CYLINDER-TYPE AXIALLY COMPACT BRAKE

This application is a continuation of application Ser. No. 07/041,970, filed Apr. 24, 1987, now abandoned.

BACKGROUND OF THE INVENTION

This invention relates to a composite hydraulic cylinder apparatus associated with a pneumatic cylinder and an oil hydraulic cylinder.

When movable elements of various types are mechanically actuated, a moving control system with a pneumatic cylinder mechanism or an oil hydraulic cylinder mechanism is generally employed, the cylinder mechanisms are also used as buffer means when the movable elements are stopped, and these mechanisms have merits and demerits as discussed hereinafter.

Since air is a pressure medium in the case of a moving control system with the pneumatic cylinder mechanism, the entire apparatus which contains primarily of an air cylinder and a switching valve together with a control system can be inexpensively constructed, but since the pressure medium is compressible fluid, the responsiveness of the mechanism when the movable element is stopped is often erroneous and has low reliability.

To eliminate the drawbacks, a mechanical brake means is provided via a piston rod. The piston rod moves during a period of the braking state in the case of stopping at an intermediate stroke position of the brake means so that the movable element overruns the target stopping position, and the positioning accuracy of the movable element is erroneous.

In addition, the abovementioned mechanical brake means generally has other drawbacks such as small holding force, low reliability, wear of the brake due to repeated use for a long term to cause the braking characteristic to be deteriorated.

Since the pressure medium (oil) is noncompressible fluid in case of the movable element control system with the oil hydraulic cylinder mechanism and the movement of the piston immediately stops when high pressure oil supply into the cylinder is stopped, the positioning performance is good, and larger output and holding force can be provided by the noncompressive pressure medium, but since the oil hydraulic unit is ordinarily expensive and large sized, it is difficult to satisfy the inexpensive facility cost and space-saving requirements.

As a new proposal to eliminate the drawbacks of the abovementioned cylinder mechanisms, there is a combination of two sets of cylinder units associated by disposing in tandem or parallel to drive a movable element partly by a pneumatic pressure and to brake the element partly by an oil hydraulic pressure, thereby controlling to position the movable element by a stop valve provided in the oil passage of the oil hydraulic system.

Since such a proposed example moves the movable element by a pneumatic system, and stops the element by an oil hydraulic system, the apparatus can be inexpensive as compared with the case that the entire system is composed of an oil hydraulic system, the positioning accuracy of the movable element can be enhanced by the oil hydraulic control, and the example enhances the economy and the operability since the stop valve of the oil passage of the oil hydraulic system is provided as the control of the movable element and may be merely opened or closed.

Since a plurality of independent cylinder units are disposed in tandem or parallel and associated in the proposed example, the longitudinal or lateral size is increased by the plural cylinder units, and this example could be improved in the compact construction and size.

Further, there is no interchangeability in the buffer means when the movable element is stopped.

SUMMARY OF THE INVENTION

Accordingly, an object of this invention is to provide a composite hydraulic cylinder apparatus which can eliminate the abovementioned drawbacks and satisfy high positioning accuracy, a large holding force, economy and small size as a movable element control system, and can be applied as a buffer for the movable element.

In order to achieve the above and other objects, there is provided according to the invention a composite hydraulic cylinder apparatus comprising a pneumatic cylinder mechanism, a braking oil hydraulic cylinder mechanism associated concentrically with the pneumatic cylinder mechanism, an oil passage for communicating between the front chamber and the rear chamber of the oil hydraulic cylinder mechanism, and a control valve provided in the oil passage for controlling the flow of the oil.

The above and other related objects and features of the invention will be apparent from a reading of the following description of the disclosure found in the accompanying drawings and the novelty thereof pointed out in the appended claims.

DETAILED DESCRIPTION OF THE PREFERRED EMBODIMENTS

Embodiments of a composite hydraulic cylinder apparatus according to the present invention will be described in detail with reference to the accompanying drawings.

Figure 1:
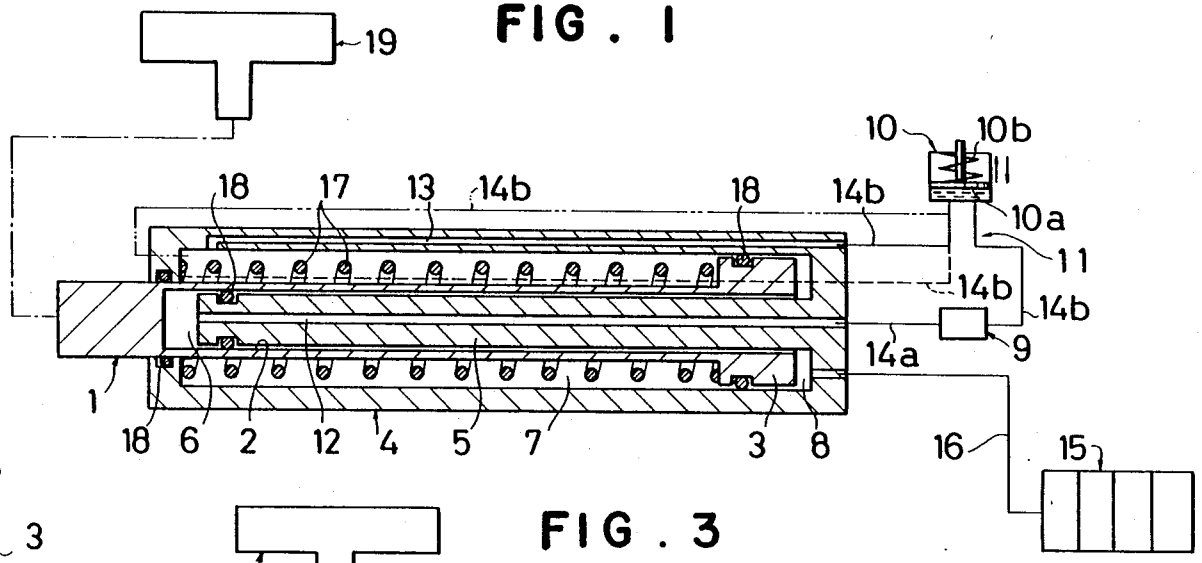
FIG. 1 is a sectional view showing an embodiment of a composite hydraulic cylinder apparatus according to the present invention.

FIG. 1 shows a movable element moving control system as a first embodiment of a composite hydraulic cylinder apparatus according to the present invention.

In FIG. 1, the composite hydraulic cylinder apparatus has a hollow piston rod 1 which is also used as an internal cylinder 2, a piston 3 provided on the outer periphery of the end of the piston rod 1, and an external cylinder 4 having a hollow rod 5 at the axial center therein.

The internal cylinder 2 and the hollow rod 5, and the piston 3 and the external cylinder 4 are respectively engaged snugly with each other and associated slidably with each other.

The internal volume which varies by the relative movement of the internal cylinder 2 and the rod 5 forms an oil hydraulic rear chamber in the associated structure of the internal cylinder 2 and the rod 5.

The cylinder chambers, which vary in volume in the external cylinder 4 by the movement of the piston 3 form at one side an oil hydraulic front chamber 7 and at the other side a pneumatic chamber 8. The rear chamber 6 of the internal cylinder 2 communicates with the front chamber 7 of the external cylinder 4 through an oil passage 11 having a control valve 9 and an oil chamber 10.

In FIG. 1, the oil passage 11 is composed of a hollow portion 12 of the hollow rod 5 described above, a passage 13 perforated in the cylindrical wall of the external cylinder 4, and conduits 14*a* and 14*b* respectively arranged between the control valve 9 and the hollow portion 12 of the rod 5, and between the control valve 9 and the passage 13 through the oil chamber 10. The control valve 9 connected between the conduits 14*a* and 14*b* is, for example, formed of an electromagnetic stop valve, and the variable volume type oil chamber 10 contains a pressure bearing plate 10*a* disposed therein and a spring 10*b* biased between one side of the bearing plate 10*a* and one side end of the oil chamber 10 for urging the oil contained therein by pressurizing the bearing plate 10*a*.

A pneumatic unit 15 which has a compressor, a pressure regulating tank, a switching valve and a controller is connected through a conduit 16 to the pneumatic chamber 8 of the external cylinder 4.

A coiled compression spring 17 is contained in the oil hydraulic front chamber 7 of the external cylinder 4 to reciprocate the piston rod 1 having the piston 3.

Sealing members 18 for holding the airtightness and the liquidtightness are mounted between the rod 5 and the internal cylinder 2, and between the piston 3 and the external cylinder 4 as well as between the piston rod 1 and the external cylinder 4.

The first embodiment in FIG. 1 is of a single-acting type, and the hollow piston rod 1 which is also used as the internal cylinder 2 becomes an output shaft, and is coupled directly or through transmitting means to a movable unit 19.

The movable unit 19 may be any movable element of various types such as, for example, a movable table of a machine tool, a scanner for a sensor, an article storing tray, or a switching member of a mechanical switching machine.

In the embodiment in FIG. 1, when the movable unit 19 is moved, the control valve (stop valve) 9 of the passage 11 is opened to communicate between the oil hydraulic rear chamber 6 of the internal cylinder 2 and the oil hydraulic front chamber 7 of the external cylinder 4, and high pressure air is then supplied from the conduit 16 connected to the pneumatic unit 15 into the pneumatic chamber 8 of the external cylinder 4.

When the high pressure air is thus supplied into the pneumatic chamber 8, the piston rod 1 is moved out from the external cylinder 4 to transmit the movement of the piston rod 1 to the movable unit 19, thereby moving the movable unit 19 in a predetermined direction.

In this case, the internal volume of the oil hydraulic front chamber 7 decreases by the relative movement of the piston 3 and the external cylinder 4, the internal volume of the oil hydraulic rear chamber 6 increases by the relative movement of the internal cylinder 2 and the hollow rod 5, and the oil in the oil hydraulic front chamber 7 thus flows out through the oil passage 11 into the oil hydraulic rear chamber 6.

The rear chamber 6 of the internal cylinder 2 and the front chamber 7 of the external cylinder 4 are so designed that the volumetric changes of the rear and front chambers 6 and 7 are equal to one another. Thus, the oil flows from the front chamber 7 into the rear chamber 6 smoothly without trouble, but if the volumetric chambers of the rear and front chambers 6 and 7 are unequal due to an irregularity of the working accuracies, the variable volume oil chamber 10 can operate to absorb the unequal volume.

Then, when the movable unit 19 is stopped at the desired position within an effective stroke, the control valve 9 in the oil passage 11 is switched to a closed state to shut off the oil passage through the oil hydraulic front chamber 7 and the oil hydraulic rear chamber 6 of the external cylinder 4.

Since the flow of noncompressible fluid (oil) in the front and rear chambers 7 and 6 stops in this case, even if the high pressure air is continuously fed into the pneumatic chamber 8, the piston rod 1 does not move, and, when the valve 9 is accordingly stopped, the movable unit 19 simultaneously stops to position the movable unit 19.

When the conduit 16 is opened by the switching valve with the atmosphere, the piston rod 1 with the piston 3 returns by the compression spring 17 to be retracted into the external cylinder 4.

The embodiment in FIG. 1 can employ the following various modifications.

The hollow rod 5 may be, for example, a hollow piston coupled with a hollow piston rod.

The control valve 9 is composed of a stop valve and a throttle valve, or a single valve having throttling function and stopping function.

The conduit 14*b* of the oil hydraulic system may be arranged as designated by a broken line between the oil chamber 10 and the front chamber 7 of the external cylinder 4 or a two-dotted broken line in FIG. 1 between the oil chamber 10 and the end of the front chamber 7.

Figure 4:
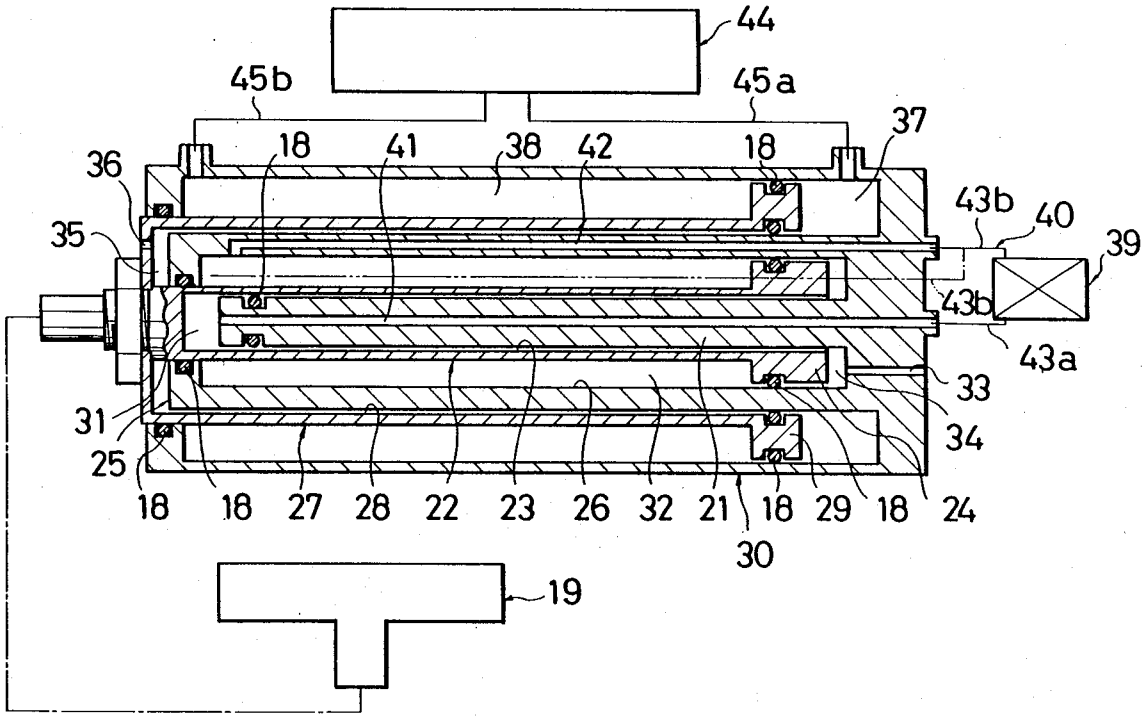

As designated by a broken line in FIG. 4, the conduit 14*b* is provided through the piston 3, the conduit 14*b* can slide in the penetrating portion of the conduit 14*b* to hold airtightly and liquidtightly therebetween, and the passage 13 of the external cylinder 4 can be omitted.

Figure 2:
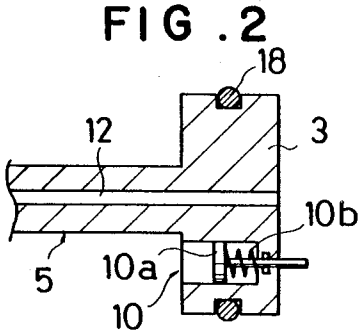
FIG. 2 is a sectional view showing another example of an oil hydraulic piston in the embodiment of the invention.

The oil chamber 10 may be formed in the oil passage 11, or may be formed integrally with the piston 3 as shown in FIG. 2.

The chambers 6, and 7, 8 of the internal and external cylinders 2 and 4 may be so formed that the chambers 7 and 8 are oil hydraulic front and rear chambers and the chamber 6 is a pneumatic chamber. In this case, the oil passage 11 having a control valve 9 and an oil chamber 10 is connected between the chamber 7 and the chamber 8, and the conduit 16 of the pneumatic unit 15 is connected to the chamber 6.

When the piston rod 1 is fixedly secured, the external cylinder 4 becomes an output side.

The oil hydraulic rear and front chambers are so designed that the volumetric changes thereof become equal as described above, and when the working accuracy of the arrangements is high in this case, the oil chamber 10 might be omitted.

The second embodiment of a composite hydraulic cylinder apparatus according to the present invention will be described with reference to FIG. 3.

Figure 3:
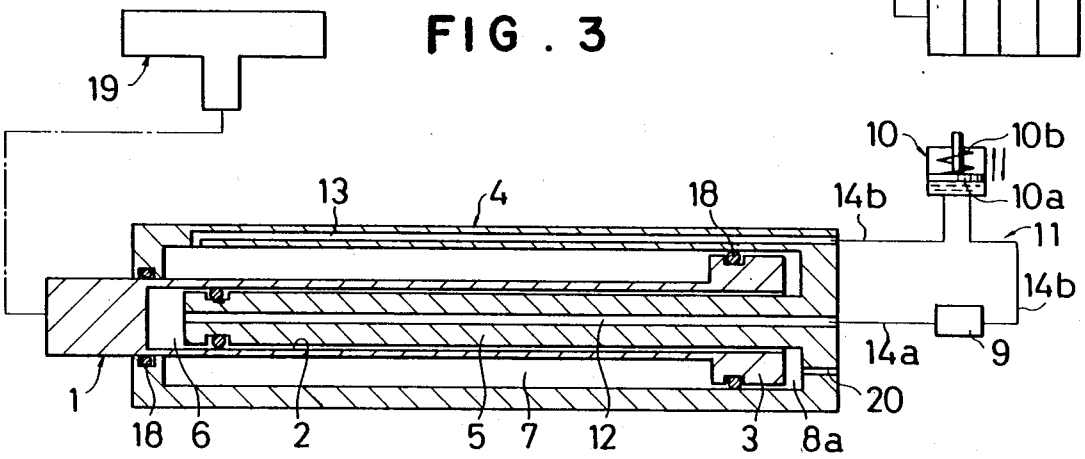
FIGS. 3 to 5 are sectional views showing the second to fourth embodiments of a composite hydraulic cylinder apparatus of the invention.

The second embodiment of the invention in FIG. 3 is a composite hydraulic cylinder apparatus for buffering a movable unit, and has fundamentally the same construction as the first embodiment in FIG. 1 except that a control valve of an oil passage 11 between an oil hydraulic rear chamber 6 and an oil hydraulic front chamber 7 is formed of a throttle valve, an open chamber 8*a* is opened through an opening 20 with the atmosphere, and the compression spring 17 is omitted.

A pneumatic system is of a no-load type only with the open chamber 8*a*.

In the second embodiment in FIG. 3, the piston rod 1 disposed correspondingly to the stopping position of the movable unit 19 extends from the external cylinder 4, and when the movable unit 19 arrives at the stopping position, the movable unit 19 collides with the piston rod 1.

In this case, the piston rod 1 is pushed by the movable unit 19 into the external cylinder 4, the volume in the oil hydraulic rear chamber 6 decreases by the relative movements of the internal cylinder 2 and the hollow rod 5, and the volume in the oil hydraulic front chamber 7 increases by the relative movements of the piston 3 and the external cylinder 4. Thus, the oil in the front chamber 7 flows from the oil passage 11, to the rear chamber 6 by such volumetric changes.

In this case, the oil passing through the oil passage 11 is controlled to flow by the control valve 9 having a throttle valve to decelerate the oil passage from the front chamber 7 to the rear chamber 6, thereby smoothing the operation of the piston rod 1 to decelerate the movable unit 19 in contact with the rod 1.

Thus, the movable unit 19 is stopped while alleviating in the impact when transferring from the moving state to the stopping state.

In the second embodiment described above, the piston rod 1 having the piston 3 may have a compression spring 17 described above in the open chamber 8*a*, or may be projected out of the external cylinder 4 by blowing air into the open chamber 8*a*.

In addition, the second embodiment of the invention may also be modified in the same manner as the first embodiment in a possible scope.

A third embodiment of a composite hydraulic cylinder apparatus of the invention will be described with reference to FIG. 4.

The third embodiment in FIG. 4 is of a moving control system of a movable unit in the same manner as the first and second embodiments, but of double-acting type.

In FIG. 4, the third embodiment has a hollow rod 21, a first hollow piston rod 22 which operates also as a first cylinder 23, a first piston 24 which is provided at one end of the first piston rod 22, a second hollow piston rod 25 which operates also as a second cylinder 26, a third hollow piston rod 27 which operates also as a third cylinder 28, a second piston 29 which is provided at one end of the third piston rod 27, and a fourth cylinder 30.

The hollow rod 21, the second piston rod 25 and the fourth cylinder 30 of these components of the third embodiment are integrally coupled concentrically so that the hollow rod 21 is disposed at the center, the second piston rod 25 is disposed on the outer periphery thereof and the fourth cylinder 30 is disposed further on the outer periphery thereof.

The first piston rod 22 and the third piston rod 27 are also integrally coupled at the concentrical disposition that the first piston rod 22 is disposed inside and the third piston rod 27 is disposed outside.

Further, the hollow rod 21 and the first cylinder 23, the first piston 24 and the second cylinder 26, the second cylinder 26 and the third cylinder 28, the second piston 29 and the fourth cylinder 30 are respectively slidably engaged snugly with each other in a sealing manner.

In the associated arrangements described above, the first cylinder 23 varies in volume therein by the relative movement with the hollow rod 21 to form an oil hydraulic rear chamber 31.

The second cylinder 26 varies in volume at both side cylinder chambers thereof by the relative movement with the first piston 24 in such a manner that one forms an oil hydraulic front chamber 32 and the other forms an open chamber 34 opened through an opening 33 with the atmosphere.

The third cylinder 28 varies in volume by the relative movement with the second piston rod 25 to form an open chamber 35, which communicates through an opening 36 with the atmosphere.

The fourth cylinder 30 varies in volumes therein at both side cylinder chambers thereof by the relative movement with the second piston 29 in such a manner the one forms a pneumatic rear chamber 37 and the other forms a pneumatic front chamber 38.

The oil hydraulic rear and front chambers 31 and 32 communicate through an oil passage 40 having a control valve 39 with one another.

The passage 40 in FIG. 4 is composed of a hollow portion 41 of the hollow rod 21, a passage 42 perforated in the cylindrical wall of the second cylinder 26, and conduits 43*a*, 43*b* arranged between the hollow portion 41 and the passage 42 in a manner as shown in FIG. 4, and a control valve 39 made, for example, of an electromagnetic stop valve is provided between the conduits 43*a* and 43*b*.

A pneumatic unit having a compressor, a pressure regulating tank, a switching valve and a controller is connected through conduits 45*a* and 45*b* to the pneumatic rear and front chambers 37 and 38, respectively.

In FIG. 4, sealing members 81 and a movable unit 19 are constructed in the same manner as those in the previous embodiments.

When the movable unit 19 is moved in the third embodiment in FIG. 4, the control valve (stop valve) 39 of the oil passage 40 is opened to communicate between the rear chamber 31 and the front chamber 32, and high pressure air is then supplied through the conduit 45*a* connected to the pneumatic unit 44 into the pneumatic rear chamber 37.

When the high pressure air is supplied into the pneumatic rear chamber 37, the third piston rod 27 is projected from the fourth cylinder 30 through the second piston 29 effected by the pressure of the air in this case, the first piston rod 22 coupled to the third piston rod 27 is accordingly projected from the second cylinder 26, and the projecting movements of the piston rods are transmitted to the movable unit 19 to cause the movable unit 19 to move in a predetermined direction.

In this case, when the volume in the front chamber 32 decreases, the volume in the rear chamber 31 simultaneously increases. Thus, the oil in the front chamber 32 flows through the oil passage 40 to the rear chamber 31 in the same manner as described above.

As seen in FIG. 4, sections of oil hydraulic front chamber 32 and oil hydraulic rear chamber 31 overlap one another concentrically or coaxially. Thus, the overall length is made compact. Since the axial expansion of one chamber has a corresponding axial contraction of the other chamber.

Then, when the movable unit 19 of moving state is stopped at the desired position within an effective stroke, the control valve 39 of the oil passage 40 is switched to its closed state to shut off the oil passage 40 between the rear chamber 31 and the front chamber 32. Thus, since the flow of noncompressive fluid (oil) in both the chambers 31 and 32 is stopped by the shut off of the oil passage, the piston rods do not move in the same manner as described above, and the movable unit 19 accordingly stops simultaneously when the control valve 39 is closed.

In order to move the movable unit 19 in the reverse direction to that described above, the high pressure air is supplied into the front chamber 38 to intrude the piston rods into the respective cylinders. In this case, the control valve 39 of the oil passage 40 is switched to its closed state to shut off the oil passage between the rear chamber 31 and the front chamber 32, thereby stopping the movable unit 19 at a predetermined position.

Then, modifications of the fourth embodiment in FIG. 4 will be described.

In FIG. 4, a plurality of cylinder chambers, i.e., front chambers which decrease in volumes when the piston rods are projected from the respective cylinders, and a plurality of cylinder chambers, (i.e., rear chambers which decrease in volumes when the piston rods retract into the respective cylinders) are provided, and arbitrary set of the plurality of rear and front chambers are employed for oil hydraulic rear and front chambers, and pneumatic rear and front chambers.

More specifically, in the arrangement that arbitrary set of rear and front chambers are used for oil hydraulic system, and other arbitrary set of rear and front chambers are used for pneumatic system, conduits of oil hydraulic system are connected between the oil hydraulic rear and front chambers, and conduits of pneumatic system are connected between the pneumatic rear and front chambers, and the remaining rear and front chambers are arranged to communicate with the atmosphere.

The oil hydraulic rear and front chambers described above are preferably designed to change their volumes equally as described above, but if the volumetric changes of the rear and front chambers are not equal, the oil chamber is provided in the oil passage, or an oil chamber as shown in FIG. 2 is provided in the oil hydraulic piston.

The control valve 29 is composed of a stop valve and a throttle valve as described above, or a single valve having throttling function and stopping function.

The conduit **43*b* of the oil hydraulic system may be arranged as designated by two-dotted broken line in FIG. 4. In this case, the passage 42 perforated in the cylindrical wall of the second cylinder 25** is omitted.

When the piston rods are fixedly secured, the cylinders become output sides.

Then, a fourth embodiment of a composite hydraulic cylinder apparatus of the invention will be described with reference to FIG. 5. The fourth embodiment is used for a moving control system of a movable unit, which is constructed fundamentally the same as the double-acting type in FIG. 4.

Figure 5:
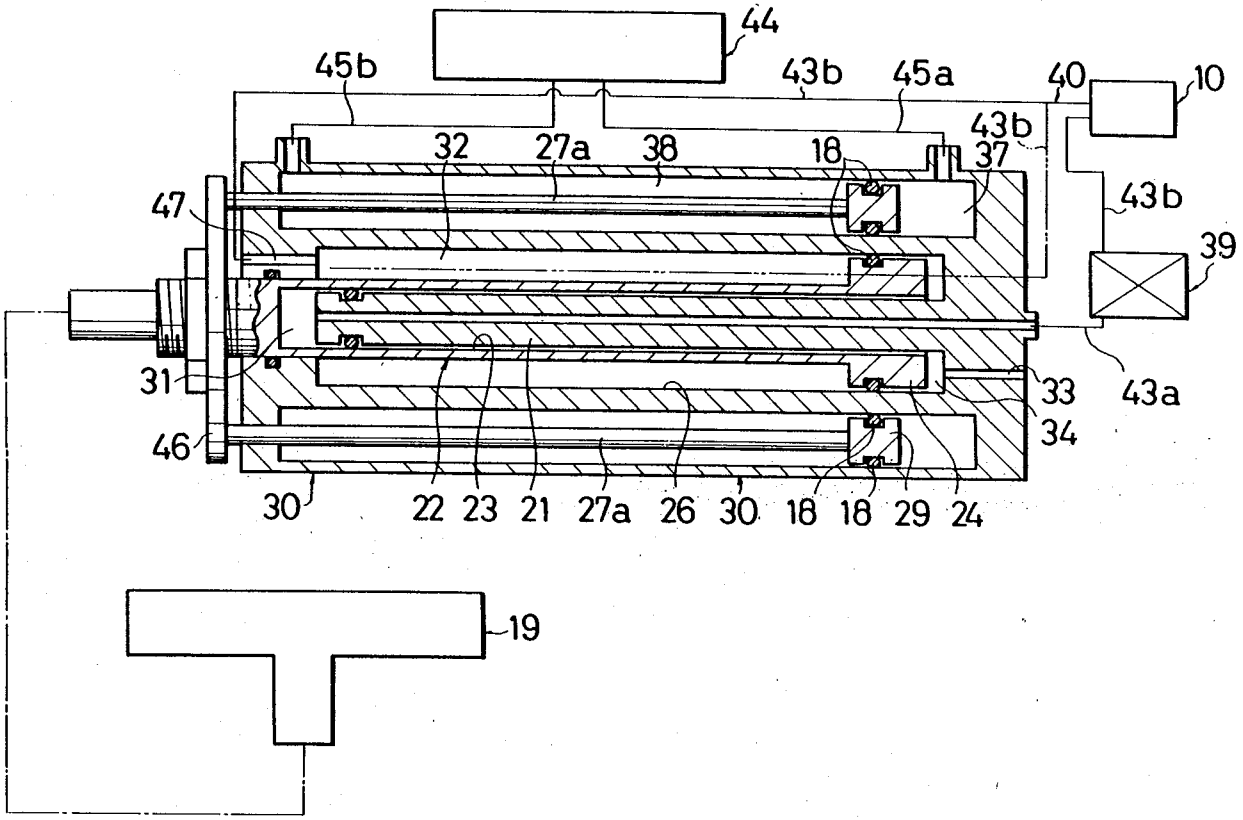

Therefore, the different points of the fourth embodiment in FIG. 5 from the third embodiment in FIG. 4 will be merely described.

In FIG. 5, a second cylinder 26 is fixedly secured to a head cover and an end cover of a fourth cylinder 30.

A third piston rod **27*a* is formed of a plurality of rods different from the cylindrical shape described above and a first piston rod 22 are coupled through a plate-like coupler 46 formed, for example, in a tie plate as shown in FIG. 5. Therefore, the third cylinder 28 and the open chamber 35 of the third embodiment in FIG. 4 are not provided in the fourth embodiment in FIG. 5**.

One **43*b* of the conduits 43*a*, 43*b* of the oil passage 40 is so arranged as designated by a solid line or a two-dotted broken line in FIG. 5. In case of the solid line, the conduit 43*b* is connected to an opening 47**.

When an opening (not shown) which communicates with an oil hydraulic rear chamber 31 is perforated at the left end side of a first piston rod 22, the conduit 43a is connected to the opening.

In this case, a hollow rod 21 may be formed of a normal rod without hollow portion 41.

In addition, the modifications described with reference to FIGS. 1 to 4 may also be employed in a possible scope in the fourth embodiment in FIG. 5.

In the fourth embodiment in FIG. 5, the movable unit 19 is moved by a pneumatic system, and controlled to be positioned by an oil hydraulic system, and the operating state is substantially the same as that of the third embodiment in FIG. 4, and the description will be omitted.

In the first, second and third embodiments of FIGS. 1, 3 and 4, the passage 13 of the external cylinder 4 and the passage 42 of the second piston rod 25, which also acts as the second cylinder 26, in case the external cylinder 4 and the second piston rod 25 are double walled, can be formed using the inner space of the double-wall construction. In this case, the inner space can be communicated with the front chamber 7 and the conduit **14*b* (FIGS. 1 and 3) and the oil hydraulic front chamber 32 and the conduit 43*b* (FIG. 4) by providing one or more openings in the inner wall of the double wall or using the conduits such as 14*b* and 43*b***.

As described above, the composite hydraulic cylinder apparatus of the present invention comprises a pneumatic cylinder mechanism, a braking oil hydraulic cylinder mechanism associated concentrically with the pneumatic cylinder mechanism, an oil passage for communicating between the front chamber and the rear chamber of the oil hydraulic cylinder mechanism, and a control valve provided in the oil passage for controlling the flow of the oil. Therefore, a single-acting type, a double-acting type or a no-load type is employed in the composite hydraulic cylinder apparatus as the pneumatic cylinder mechanism, and the apparatus can be applied to a control system for moving the movable unit to stop it at the desired position or to buffer means at the time of stopping the movable unit. In this case, the accuracy can be increased by the oil hydraulic system, and the economy of the apparatus can be satisfied by the pneumatic system. Further, the pneumatic cylinder mechanism and the oil hydraulic cylinder mechanism are associated in the concentric arrangement to avoid the long length and large width as observed in the existing double-acting type, thereby reducing the size of the composite hydraulic cylinder apparatus.

What is claimed is:

1. A composite hydraulic cylinder apparatus comprising a pneumatic cylinder mechanism and a braking oil hydraulic cylinder mechanism associated concentrically with the pneumatic cylinder mechanism, wherein sections of a front chamber and a rear chamber of the braking oil hydraulic cylinder mechanism overlap concentrically so as to equalize the volume changes of the chambers, said chambers being communicated through an oil passage with a control valve provided therein to control the flow of the oil.

2. The composite hydraulic cylinder apparatus according to claim 1, wherein said pneumatic cylinder mechanism is of a single-acting type.

3. The composite hydraulic cylinder apparatus according to claim 1, wherein said pneumatic cylinder mechanism is of a double-acting type.

4. The composite hydraulic cylinder apparatus according to claim 1, wherein said pneumatic cylinder mechanism is of a no-load type.

5. The composite hydraulic cylinder apparatus according to claim 1, wherein said control valve has at least one of a throttle valve and a stop valve.

6. The composite hydraulic cylinder apparatus according to claim 1, wherein an oil chamber is provided in the oil passage.

7. The composite hydraulic cylinder apparatus according to claim 1, wherein an outer cylinder wall portion of said braking oil hydraulic cylinder mechanism is of a dual wall construction and an inner space of said dual wall construction forms a part of the oil passage to communicate the front chamber with the rear chamber of said braking oil hydraulic cylinder mechanism.

8. The composite hydraulic cylinder apparatus according to claim 1, wherein an oil chamber is provided in the piston of the oil hydraulic system.

* * * * *